US009995531B2

(12) United States Patent
Ayala Barreto

(10) Patent No.: US 9,995,531 B2
(45) Date of Patent: Jun. 12, 2018

(54) MULTIPLE INTERMITTENCE BEEHIVE GRAIN DRYER

(71) Applicant: COOL SEED INDÚSTRIA E COMÉRCIO DE EQUIPAMENTOS AGRÍCOLAS LTDA, Santa Tereza do Oeste (BR)

(72) Inventor: Francisco Maria Ayala Barreto, Cascavel (BR)

( * ) Notice: Subject to any disclaimer, the term of this patent is extended or adjusted under 35 U.S.C. 154(b) by 221 days.

(21) Appl. No.: 14/752,973

(22) Filed: Jun. 28, 2015

(65) Prior Publication Data

US 2016/0040932 A1 Feb. 11, 2016

(30) Foreign Application Priority Data

Aug. 6, 2014 (BR) ..... 10 2014 019434 7

(51) Int. Cl.
*F26B 17/12* (2006.01)
*F26B 25/00* (2006.01)
(Continued)

(52) U.S. Cl.
CPC ..... *F26B 17/126* (2013.01); *F26B 17/001* (2013.01); *F26B 17/003* (2013.01);
(Continued)

(58) Field of Classification Search
CPC .. F26B 17/14; F26B 17/1406; F26B 17/1408; F26B 17/1416; F26B 17/1425;
(Continued)

(56) References Cited

U.S. PATENT DOCUMENTS 3,701,203 A * 10/1972 Anderson ..... F26B 17/1416 34/170
4,125,945 A * 11/1978 Westelaken ..... A23B 9/08 34/167

(Continued)

FOREIGN PATENT DOCUMENTS

| | | |
|---|---|---|
| BR | PI0403421 A | 3/2006 |
| BR | MU 8602084-6 U | 5/2008 |
| CN | 101738074 A | 6/2010 |

*Primary Examiner* — Kenneth Rinehart
*Assistant Examiner* — Raymond Williamson
(74) *Attorney, Agent, or Firm* — Brian J. Pangrle

(57) ABSTRACT

"MULTIPLE INTERMITTENCE BEEHIVE GRAIN DRYER", refers to a dryer of seeds and other agricultural products that can be a constructive format honeycomb type dryer designed to provide a unprecedented process of multiple intermittence during fast, gentle, non-aggressive drying process of grains and seeds through complete and safe removal of accumulated moisture, being divided into the following stages: drying-resting-drying-resting-drying, and so on until drying is complete. Exposure time to drying air is monitored and allows recirculation of humid air, it also allows batch or continuous drying with a thermally insulated plenum that removes dirty humid air located in the bottom section, without releasing it directly into the environment, with advantages of low production cost, dry grain of much higher quality, better energy efficiency, environmentally friendly and capable of virtually eliminating any accidental risks.

4 Claims, 8 Drawing Sheets

(51) Int. Cl.
*F26B 17/00* (2006.01)
*F26B 17/14* (2006.01)

(52) U.S. Cl.
CPC ..... *F26B 17/122* (2013.01); *F26B 17/1416* (2013.01); *F26B 25/002* (2013.01); *F26B 2200/06* (2013.01)

(58) Field of Classification Search
CPC ..... F26B 17/1433; F26B 17/1441; F26B 17/145; F26B 17/1458; F26B 17/00; F26B 17/001; F26B 17/12; F26B 17/122; F26B 17/124; F26B 17/126; F26B 17/128; F26B 2200/06; F26B 2200/08; F26B 21/00; F26B 9/066; F26B 9/003; F26B 9/063
USPC ..... 34/165, 167, 168, 170, 177, 507, 509
See application file for complete search history.

(56) References Cited

U.S. PATENT DOCUMENTS 4,486,960 A 12/1984 Jean et al.
5,443,539 A * 8/1995 Westelaken ..... F26B 17/1416 34/168
6,223,451 B1 5/2001 Satoru et al.

* cited by examiner

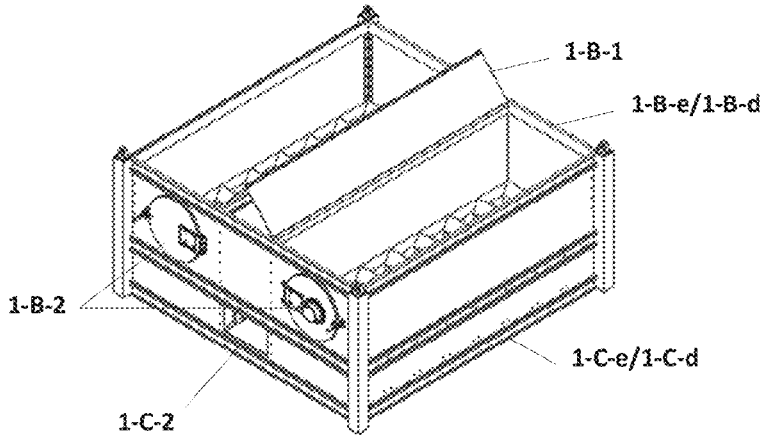
FIG. 4-A
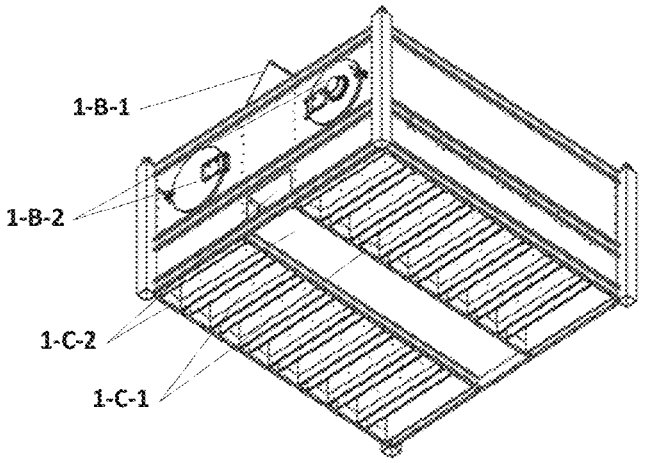
FIG. 4-B
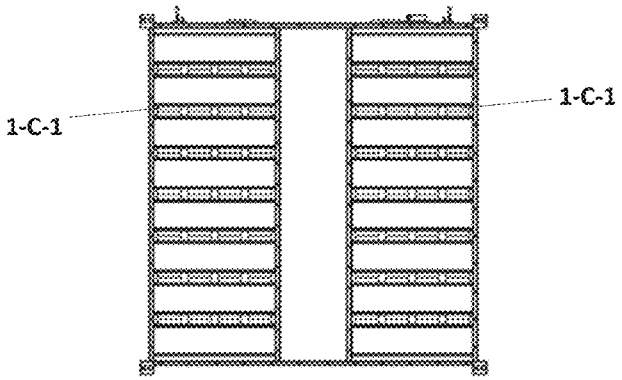
FIG. 4-C

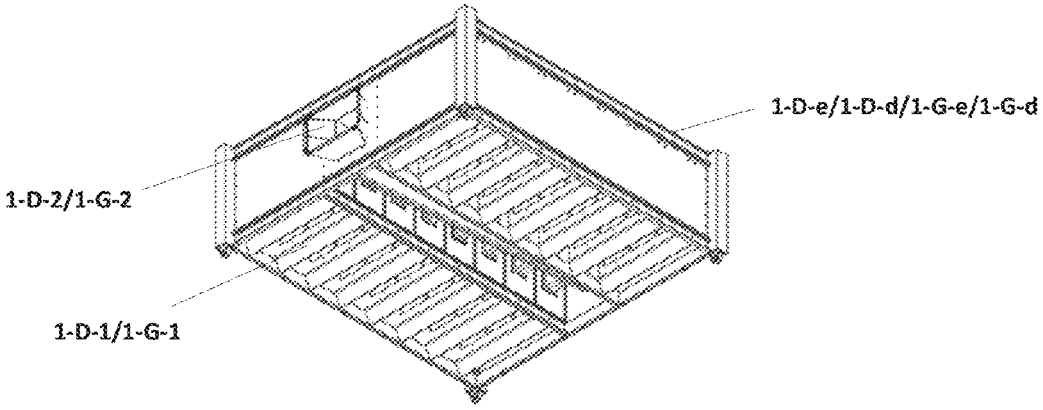
FIG. 5-A
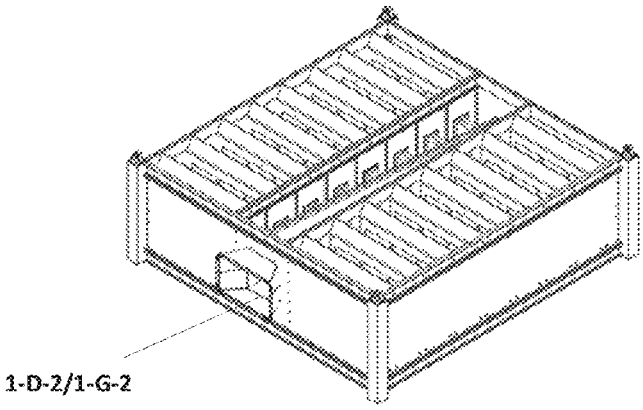
FIG. 5-B
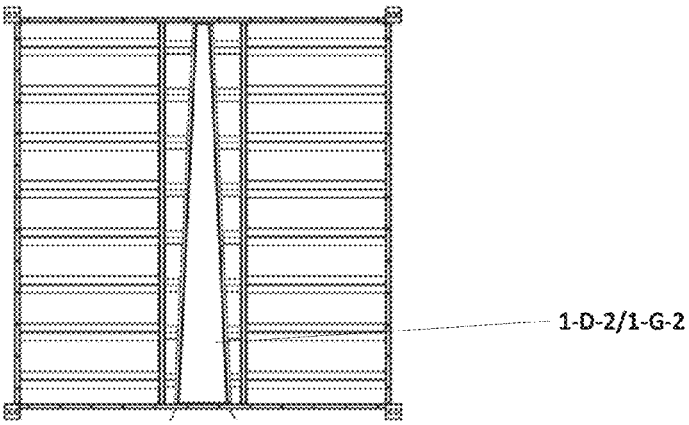
FIG. 5-C

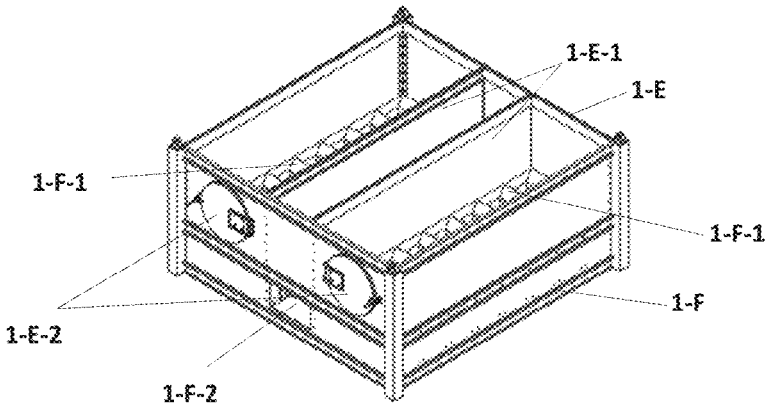
FIG. 6-A
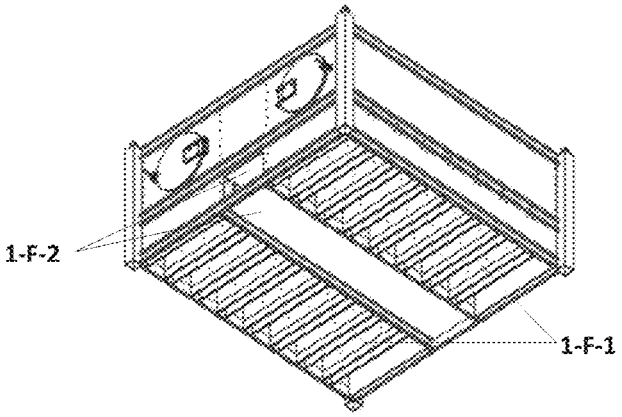
FIG. 6-B
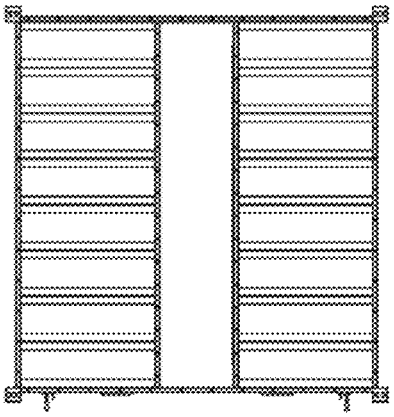
FIG. 6-C

MULTIPLE INTERMITTENCE BEEHIVE GRAIN DRYER

RELATED APPLICATIONS

This application claims priority to an application filed in Brazil on 6 Aug. 2014 and having Application No. BR 10 2014 019434 7, which is incorporated by reference herein.

BACKGROUND

It is known by manufactures and users of grain and seed dryers that the following drying methods (with respect to intermittency) are currently available to the industry:

a) Intermittent dryers (equipped with a holding chamber): commonly used for seed drying, as the overall drying process is less aggressive but slower, therefore not suitable for large-scale grain drying. In these dryers, a pulsating flow of hot air dries the product until the desired moisture is reached. This process provides effective use of thermal energy for air heating (energy efficient), mostly because of a holding chamber that accommodates small batches of grain at a time as they gradually dry, which significantly reduces its potential aggressiveness during the process. However, for faster drying rates (and the demand for faster drying has increased in the last few years), the drying air needs to be warmer, which may jeopardize the quality of the seeds. Batch drying methods are considered non-efficient because lengthy periods of time are required between product loading and unloading (usually 20 to 40% of effective drying time).

b) Uninterrupted drying: a continuous flow dryer, fed by heated air, is loaded with humid product that remains inside for a predetermined period of time until it is completely dried out and ready for uninterrupted unloading and subsequent processes. Cross-flow (column or rack), mixed, or concurrent flow dryers are included in this category. They may or may not be equipped with a cooling system, which is dependent upon the availability of cooling devices in the dying site. These dryers are generally used for grains and require large air flow intake in order to maximize drying time. They are very aggressive to the grain, causing cracks, quality loss, and major damage to the entire chain. Energy efficiency is very low and in some cases, 60% of energy is wasted during the process.

Brazilian patent MU8602084—Improvements Introduced to Grain Drying Devices. The utility model presented therein consists of a constructive structure that employs vertical towers and an external closure system, intended for static, intermittent, and continuous grain drying process, starting from the loading of product that has been already homogenized and moisture elimination through an exhaust system, interspersed with drying and internal air cooling/heating control mechanisms.

Brazilian patent PI0403421—Grain, Batch, Intermittent, and Concurrent Flow Dryers for Drying; and Counterflow Dryer for Cooling, with Suction System or Air Inflation. The operational features designed for that system provide uniform drying, requiring specific low enthalpy without causing grain damage due to thermal stress, still preserving its original properties. The technical features are commercially suitable for coffee and rice drying, or any other type of grain. It is also suitable for agriculture applications, where preprocessing units provide high drying capacity.

U.S. Pat. No. 6,223,451—Apparatus for drying granular objects involving pre-heating process. An apparatus for drying granular objects described therein has, from the top of the apparatus, a holding section; a heating section for heating the granular objects flowing down from the holding section, the heating section being provided beneath the holding section and having a plurality of air ducts to which heated air is introduced; a drying air producing section connected to the air ducts, in which the heated air from the air ducts is mixed with air taken-in from the outside of the apparatus to produce a drying air; and a drying section for drying the granular objects by directly exposing the granular objects to the drying air. The dried granular objects are taken out from a taking-out section and returned to the holding section through a bucket elevator. The apparatus further has a detector for detecting the temperature of the drying air. Based on the detected temperature, a control device controls the temperature of the heated air so as to keep the temperature of the drying air to a predetermined temperature. The temperature of the drying air can be set to a desirable temperature while the heated air for the heating is kept at a high temperature. The drying operation is performed speedily and safely.

U.S. Pat. No. 4,486,960—Modular drier for drying grains. A modular drier is described therein. Each module has two fans each supplying a common diffusion chamber disposed between two columns of a group of columns. Said chambers adjoin a perforated wall of said columns comprising vertical deflectors, with the opposite wall of these columns, likewise perforated, communicating with a common chamber for exhausting the air used for drying. The technology relates to a modular drier for drying grains, in which gravity draws the grain down in parallel sheets within vertical columns crossed horizontally by the drying air.

Chinese patent CN101738074—Combined Grain Drying Machine. A combined grain drying machine is described therein. The drying machine has a lower body, a lower drying part, a lower storage part, an upper drying part, an upper storage part, an upper auger, a grain inlet elevator, a dust discharging fan, a right air passage, a loading hopper, a lower auger, a grain cleaning valve, a grain discharging elevator, a left air passage, a grain discharging pipe and the like. The drying machine is characterized in that: each of a drying machine body and the air passages adopts a building-block combined structure; the drying machine is provided with a plurality of drying sections; and each drying section comprises a storage part and a drying part. The drying machine introduces a heat medium at an appropriate temperature from a left rear part through an air inlet passage and discharges dried damp air from a right rear part through a centrifugal fan and an air outlet passage. The left air passage and the right air passage are arranged among the drying sections of the drying machine; and each of the left air passage and the right air passage comprises an upper air chamber, an upper cover plate, a lower air chamber, a lower cover plate and a vertical air pipe. The vertical pipes are connected with the upper air chamber and the lower air chamber through trilateral flanges, and are connected with each other through a quadrilateral flange. Application shows that the drying machine adopting the combined structure is convenient to manufacture, transport, assemble and disassemble and dried grains have uniform water content and high quality.

BRIEF DESCRIPTION OF THE DRAWINGS

Features and advantages of the described implementations can be more readily understood by reference to the following description taken in conjunction with the accompanying drawings.

FIGS. 4-A, 4-B and 4-C, which show the perspective views of the loading, holding, and humid air removal modules, divided into top perspective (FIG. 4-A), bottom perspective (FIG. 4-B), and top view (FIG. 4-C);

FIGS. 5-A, 5-B and 5-C, showing the drying module, divided into top perspective (FIG. 5-A), bottom perspective (FIG. 5-B), and top view (FIG. 5-C);

FIGS. 6-A, 6-B and 6-C, which shows loading and holding module views, divided into top perspective (FIG. 6-A), bottom perspective (FIG. 6-B), and top view (FIG. 6-C);

DETAILED DESCRIPTION

Figure 1:
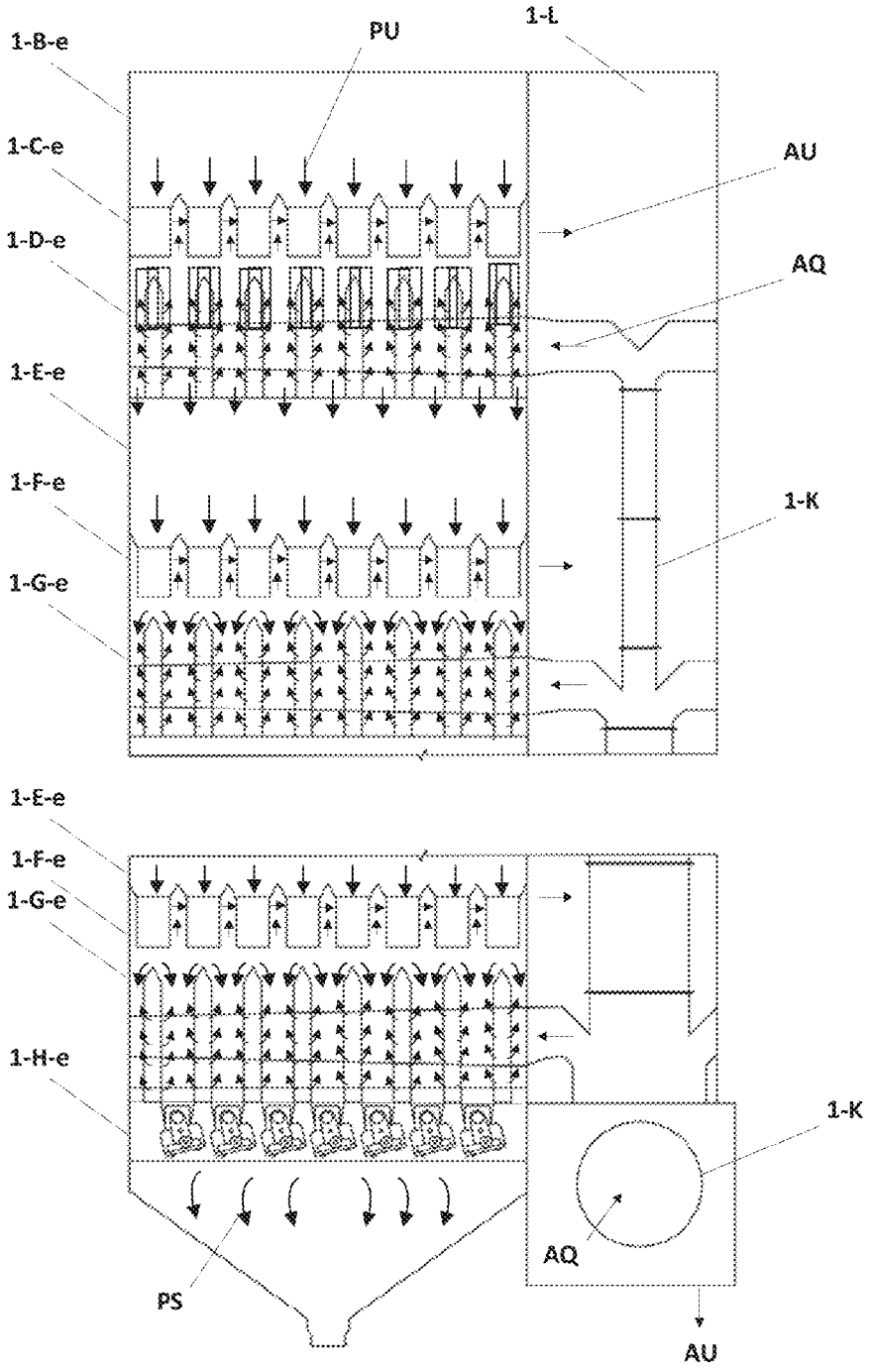
FIG. 1, which shows the schematic drawing for the drying process designed for the present patent, as exemplified for dryers equipped with two independent towers.
Figure 2:
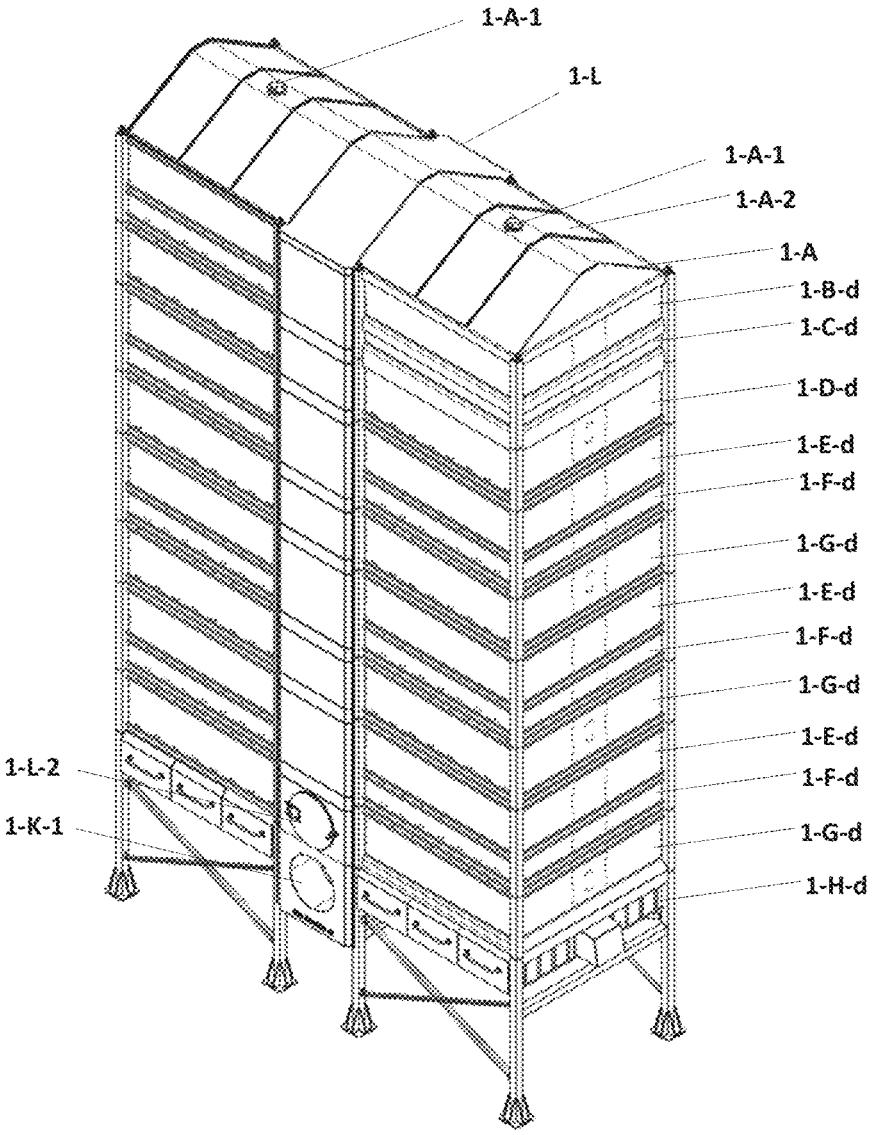
FIG. 2, which exemplifies the external front view of the dryer herein proposed, with two independent towers, each equipped with one loading and holding module, four drying and humid air removal modules, three holding modules, and one regulating flow and unloading table.
Figure 3:
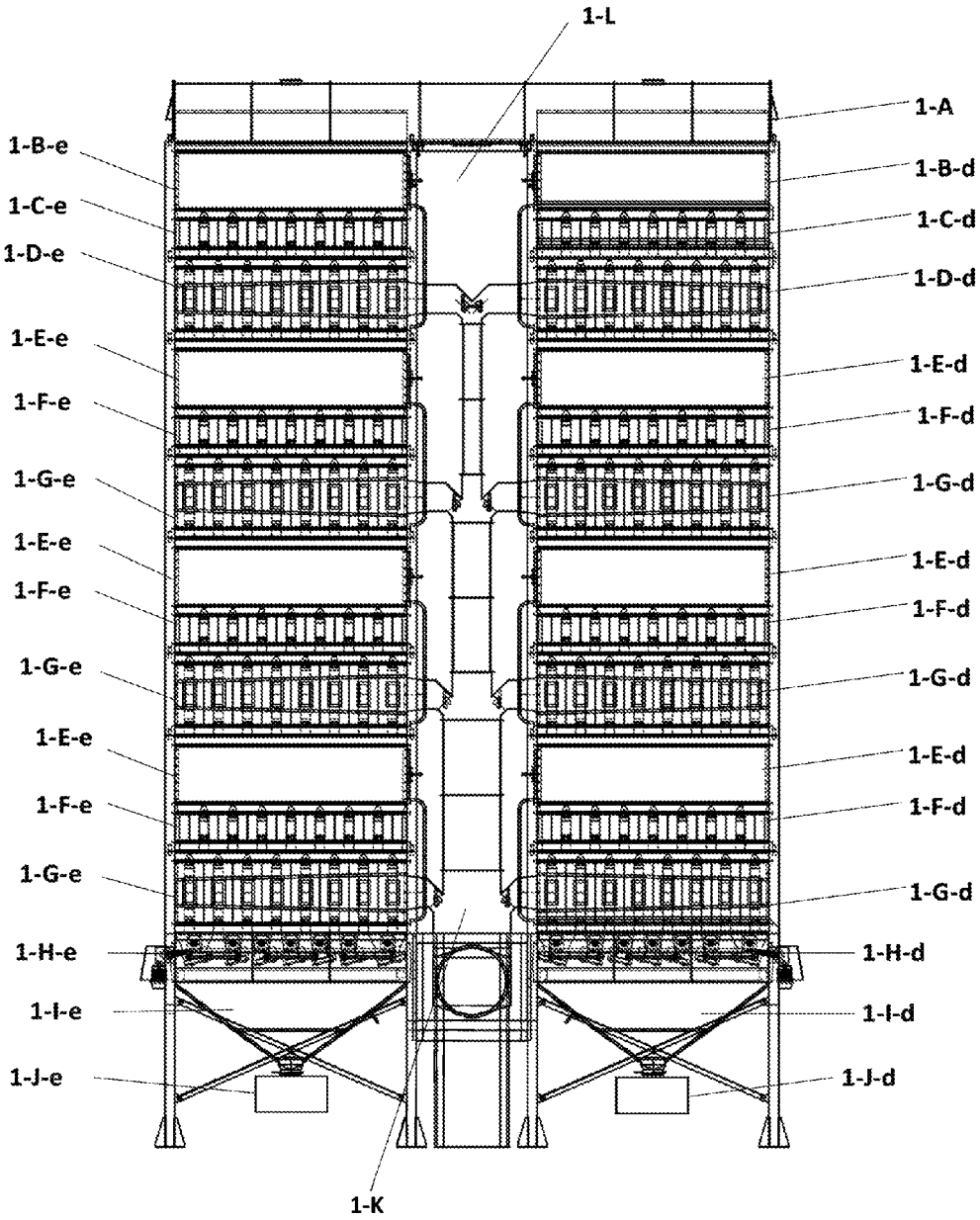
FIG. 3, which shows the sectional front view of the dryer herein proposed, with two independent towers, each equipped with one loading and holding module, four drying and humid air removal modules, three holding modules, and one regulating flow and unloading table.
Figure 7:
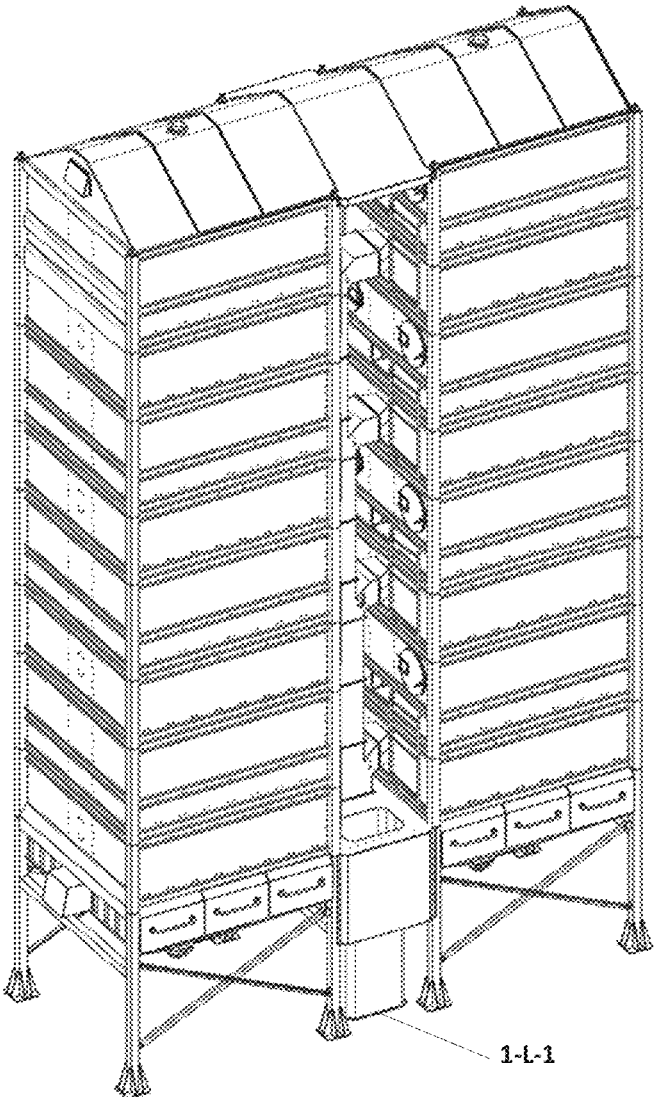
FIG. 7, which shows the external rear perspective view of the dryer herein proposed, with two parallel sets, each equipped with one loading and holding module, four drying and humid air removal modules, three holding modules, and one unloading module.

The following description includes the best mode presently contemplated for practicing the described implementations. This description is not to be taken in a limiting sense, but rather is made merely for the purpose of describing general principles of the implementations. The scope of the described implementations should be ascertained with reference to the issued claims.

Recent observations as to drying equipment have exposed disadvantages, limitations, and drawbacks, such as increased production cost, physical degradation of grain and seeds, quality loss, energy waste, environmental pollution, and risk of accidents.

Technology described herein concerns constructive format honeycomb type dryers, for example, designed to provide unprecedented multiple intermittence during fast, gentle, non-aggressive drying process of grains, seeds, and other agricultural products through complete and safe removal of accumulated moisture present on their surface, which results in dry grain of much higher quality. Such design is energy-efficient, environmentally friendly, and provides low production cost.

As an example, a multiple intermittence beehive grain dryer was designed to overcome disadvantages, limitations, and drawbacks imposed by various dryers, and provide an unprecedented process of multiple intermittence during fast, gentle, non-aggressive drying process of grains and seeds through complete and safe removal of accumulated moisture, being divided into the following stages: drying-resting-drying-resting-drying, and so on until drying is complete. Exposure time to drying air is monitored and allows recirculation of humid air through dehumidifier equipment (UTA) for further reuse. It also allows batch or continuous drying with a thermally insulated plenum that removes dirty humid air located in the bottom section, without releasing it directly into the environment. These environmentally friendly dryers provide fast drying, minimum product degradation by gently removing moisture that is accumulated on the surface of the grain, lower production costs, better energy efficiency, high quality grains, and a system capable of virtually eliminating any accidental risks.

Technology described herein aims to address some of the technical issues and design pitfalls experienced by current technologies, such as:

a) Low energy efficiency: due to large thermal waste resulting from the amount of dried product/amount of heat applied ratio, which can be adjusted if multiple chambers and intermittence are implemented;

b) Damage during drying: the amount of heat applied to increase vapor pressure on the grain and to accelerate the migration of moisture from inside the grain to outside is excessive, which may completely eliminate the natural moisture properties of the product and cause external cracks, compromising its integrity and quality. This example of a dryer is designed to adjust the exposure time set for a specific grain to drying air, and remove moisture without causing overall damage or excessive drying of its outer layer;

c) Intermittent type dryers equipped with a single chamber are generally energy-efficient, but their production capacity is limited and requires drying air set at higher temperatures, which results in loss of moisture and further damage to the outer layer of the grain. The implementation of multiple chambers, intermittence, and exposure time adjustment to drying air, in addition to monitored removal of excessive moisture guarantee the highest-quality grains available in the market.

d) Humid air is sucked through the middle or upper section of the plenum and dirty air is directly released into the environment, causing unwanted environmental damage, the design proposed herein allows recirculation of humid air at the bottom of the dryer, promoting air treatment by means of a conventional cleaning process, either dry or humid; and e) The inner sections of most dryers available in the market are hard to clean, and doing so inappropriately may result in fire or explosion. By adding to the design internal spaces intended for human access, those hard-to-reach areas can be easily cleaned without imposing occupational hazards.

The drying process sequence presented herein can include the following:

1) Humid product (PU) is fed directly into the loading and holding compartment module, which descends by gravity filling up the saturated or humid air removal upper module and upper drying module, followed by the sequential holding and saturated or humid air removal sets, and finally the flow regulators and unloading chamber, from where the dry product (PS) is removed;

2) Hot air (AQ), produced by a conventional heat source, is fed into the lower part of the hot air distribution duct that distributes hot air equitably and simultaneously into the drying module feeding inlet;

3) Hot air (AQ) first passes through the hive holes of the drying modules transversely to the downward flow of humid product, and then rises through the product layer that moves in countercurrent direction, when drying occurs. The hot air leaves the chamber through the lower section of the moisture removal module hives, and humid air (AU) is collected by the central duct connected to the hives and sent to the plenum, where it is expelled through its lower section; and 4) The migration of moisture from inside the grain to outside occurs when the product is placed inside the holding modules, where no air will be coming through, neither will the product be heated by hot air (AQ), nor removal of humid air (AU) will occur.

Figure 8:
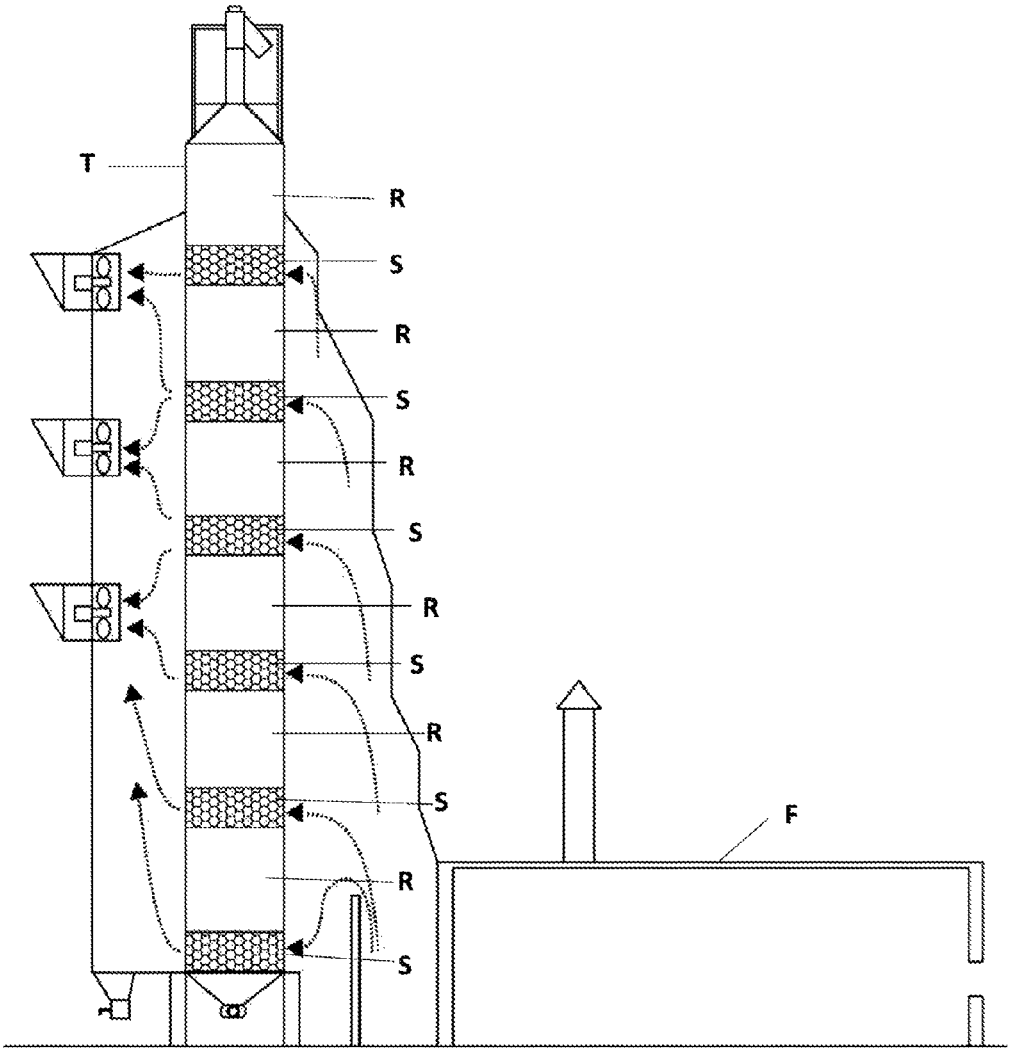
FIG. 8 Prior Art
FIG. 8, which shows the schematic drawing for conventional drying process of conventional dryers, as exemplified for dryers equipped with one tower and six holding and drying stations.

The drying process by multiple intermittence is not limited only to drying equipment that has been designed according to the attached illustrations. It is also suitable for other designs, for example, even for existing dryers available in the market, providing quick drying and less aggressiveness towards the product by gently removing moisture accumulated on its surface. FIG. 8 illustrates an application process suitable for a conventional dryer equipped with a furnace (F), a tower (T), six holding stations (R), and six drying stations (S).

According to illustrations provided, the dryer presented herein can include a feeding module to be dried (1-A), equipped with loading inlets to receive humid product to be dried (1-A-1) conventional and closed by cover (1-A-2); loading and holding module set (1-B-e) and humid air removal upper set (1-C-e) located in the left drying chamber; loading and holding module set (1-B-d) and humid air removal upper set (1-C-d) located in the right drying chamber, both chambers present a rectangular, prismatic shape, and so do the modules, which are also equipped with a deflector guide (1-B-1) and inspection doors (1-B-2), connected to the humid air removal upper module and to the feeding module to be dried (1-A), both humid air removal upper modules present rectangular, prismatic shape with hives (1-C-1) that are rectangular at the base and triangular at the top, and central duct (1-C-2) that is rectangular and prismatic, connected to the upper drying module, the loading and holding module, and to the plenum; both upper drying module (1-D-e) located in the left chamber, and upper drying module (1-D-d) located in the right chamber, present rectangular, prismatic shape with hives (1-D-1) that are rectangular at the base and triangular at the top, and a pyramidal-trunk shaped central duct (1-D-2), connected to the humid air removal modules, the holding modules, and to the hot air distribution duct; one or more sets of holding modules (1-E-e), humid air removal modules (1-F-e), and drying module (1-G-e), located in the left chamber, and one or more sets of holding modules (1-E-d), humid air removal modules (1-F-d), and drying module (1-G-d), located in the right chamber, which presents rectangular, prismatic shape, equipped with holding modules also rectangular and prismatic, two rectangular partitions (1-E-1), and access for inspection and cleaning (1-E-2), connected to the humid air removal modules and to the drying modules, with humid air removal modules that are rectangular and prismatic, and hives (1-F-1) that are rectangular at the base and triangular at the top, and rectangular, prismatic central duct (1-F-2), connected to the drying modules, holding modules, and to the plenum, and drying modules that are rectangular, prismatic, with hives (1-G-1) that are rectangular at the base and triangular at the top, and a pyramidal-trunk shaped central duct (1-G-2), connected to the moisture removal modules, holding modules, and hot air distribution duct; a regulating flow table (1-H-e), located in the left drying chamber, and a regulating flow table (1-H-d), located in the left drying chamber, connected to the unloading bins and to the drying modules; conic shaped unloading bin (1-I-e), located in the left drying chamber, and conic shaped unloading bin (1-I-d), located in the right drying chamber, both connected to the dry product removal modules (1-J-e) and (1-J-d), and to the drying modules; staggered hot air distribution duct (1-K), with inlet (1-K-1) located in the bottom section, and plenum (1-L), located between both chambers, with outlet (1-L1) and inspection door (1-L-2), located in the bottom section.

The number of drying and holding modules is determined by the total estimated volume projected for each dryer. Three to five drying and holding sets per tower are usually recommended.

Although various examples of methods, devices, systems, designs, etc., have been described in language specific to structural features and/or methodological acts, it is to be understood that the subject matter defined in the appended claims is not necessarily limited to the specific features or acts described. Rather, the specific features and acts are disclosed as examples of forms of implementing the claimed methods, devices, systems, designs, etc.

What is claimed is:

1. A multiple intermittence beehive grain dryer comprising:

a left chamber assembly and a right chamber assembly wherein each of the assemblies forms a respective tower that comprises from top to bottom a feed module (1-A) equipped with a loading inlet to receive humid product to be dried, an upper level set that comprises a loading and holding module (1-B), a humid air removal module (1-C), and a drying module (1-D), at least one additional set that comprises a holding module (1-E), a humid air removal module (1-F), and a drying module (1-G), a regulating flow table (1-H), an unloading bin (1-I), and a dry product removal module (1-J); and a hot air distribution duct (1-K) that extends in a plenum (1-L), located between the left chamber assembly and the right chamber assembly, to each of the drying modules (1-D, 1-G), wherein the loading and holding module (1-B) comprises a deflector guide (1-B-1) and inspection doors (1-B-2), wherein each of the humid air removal modules (1-C, 1-F) comprises a duct in fluid communication with the plenum (1-L) and comprises hives wherein each hive comprises structures shaped with a rectangular base and a triangular top, wherein each of the drying modules (1-D, 1-G) comprises a rectangular and prismatic duct that is in fluid communication with the hot air distribution duct (1-K), and wherein, in operation, hot air flows via the hot air distribution duct (1-K) to the rectangular and prismatic ducts of the drying modules (1-D, 1-G) and humidified air, as humidified by removal of water from the humid product to be dried, flows from the ducts of the humid air removal modules to the plenum (1-L).

2. The multiple intermittence beehive grain dryer of claim 1 comprising at least three drying modules and at least three holding modules per tower.

3. The multiple intermittence beehive grain dryer of claim 2 comprising five or less drying modules and five or less holding modules per tower.

4. A drying process by multiple intermittence comprising:

feeding humid product (PU) directly into a loading and holding compartment module, wherein the humid product (PU) descends by gravity filling up a saturated or humid air removal upper module and an upper drying module, followed by sequential holding module and saturated or humid air removal module sets associated with corresponding drying modules that are followed by a flow regulator and an unloading chamber, from where dry product (PS) is removed;

feeding hot air (AQ) into a lower part of a hot air distribution duct that distributes the hot air simultaneously into the drying modules;

passing the hot air (AQ) through hive holes of the drying modules transversely to downward flow of humid product (PU), and then rising the hot air (AQ) through a product layer of the humid product (PU) that moves in a countercurrent direction when drying occurs, wherein the hot air (AQ) leaves through a lower section of moisture removal module hives, and wherein humid air (AU) is collected by a central duct connected to the hives and then by a plenum, wherein the humid air (AU) is expelled through a lower section of the plenum; and wherein migration of moisture from inside a grain of the humid product (PU) to outside occurs when the humid product (PU) is placed inside one of the holding modules, where no air passes through, such that neither will the humid product (PU) be heated by hot air (AQ) nor will removal of humid air (AU) occur.

* * * * *